US011846245B2

(12) United States Patent
Bergmann et al.

(10) Patent No.: US 11,846,245 B2
(45) Date of Patent: Dec. 19, 2023

(54) METHOD FOR THE MODEL-BASED OPEN-LOOP AND CLOSED-LOOP OF AN INTERNAL COMBUSTION ENGINE

(71) Applicant: Rolls-Royce Solutions GmbH, Friedrichshafen (DE)

(72) Inventors: Daniel Bergmann, Bad Waldsee (DE); Knut Graichen, Heroldsberg (DE); Karsten Harder, Oberteuringen (DE); Jens Niemeyer, Friedrichshafen (DE); Jörg Remele, Hagnau (DE)

(73) Assignee: Rolls-Royce Solutions GmbH, Friedrichshafen (DE)

( * ) Notice: Subject to any disclaimer, the term of this patent is extended or adjusted under 35 U.S.C. 154(b) by 0 days.

(21) Appl. No.: 17/870,280

(22) Filed: Jul. 21, 2022

(65) Prior Publication Data

US 2022/0356852 A1 Nov. 10, 2022

Related U.S. Application Data

(63) Continuation of application No. PCT/EP2021/051077, filed on Jan. 19, 2021.

(30) Foreign Application Priority Data

Jan. 21, 2020 (DE) ..... 10 2020 00 327.3

(51) Int. Cl.
*F02D 41/14* (2006.01)
*F02D 41/30* (2006.01)

(52) U.S. Cl.
CPC ..... *F02D 41/1406* (2013.01); *F02D 41/30* (2013.01); *F02D 2041/1418* (2013.01);
(Continued)

(58) Field of Classification Search
CPC ..... F02D 41/1406; F02D 41/30; F02D 2041/1418; F02D 2041/1429;
(Continued)

(56) References Cited

U.S. PATENT DOCUMENTS 5,035,411 A * 7/1991 Daines ..... B23K 20/1205 228/2.1
6,449,944 B1 * 9/2002 Yasui ..... F02D 41/22 60/276
(Continued)

FOREIGN PATENT DOCUMENTS

DE 10 2013 206 304 A1 10/2014
DE 10 2013 220 432 A1 4/2015
(Continued)

OTHER PUBLICATIONS

International Search Report and Written Opinion dated Apr. 16, 2021 for International Application No. PCT/EP2021/051077 (14 pages).

*Primary Examiner* — Carl C Staubach
(74) *Attorney, Agent, or Firm* — Taylor IP, P.C.

(57) ABSTRACT

A method for a model-based open-loop and closed-loop control of an internal combustion engine includes the steps of: determining, via a combustion model, injection system setpoint values for controlling injection system actuators, according to a setpoint torque; adapting, during an operation of the internal combustion engine, the combustion model according to a model value, the model value being calculated from a first Gaussian process model for representing a base grid and a second Gaussian process model for representing adaptation data points; determining, by an optimizer, a minimized measure of quality by changing the injection system setpoint values within a prediction horizon, and, in an event that the minimized measure of quality is found, the injection system setpoint values are set as critical for adjust-
(Continued)

ing an operating point of the internal combustion engine; and monitoring the model value in respect of a monotony which is predefined.

6 Claims, 5 Drawing Sheets

(52) U.S. Cl.
CPC ..... *F02D 2041/1429* (2013.01); *F02D 2041/1433* (2013.01)

(58) Field of Classification Search
CPC ..... F02D 2041/1433; F02D 2041/286; F02D 35/02; F02D 41/26; F02D 2041/1412; F02D 2200/0402; F02D 41/2429; F02D 41/248
See application file for complete search history.

(56) References Cited

U.S. PATENT DOCUMENTS

| | | | | |
|---|---|---|---|---|
| 10,586,110 | B2 * | 3/2020 | Li | H04N 21/4662 |
| 11,319,888 | B2 * | 5/2022 | Graichen | F02D 41/1446 |
| 2018/0128197 | A1 * | 5/2018 | Dahodwala | F02D 41/402 |
| 2021/0003090 | A1 * | 1/2021 | Bergmann | F02D 41/3836 |
| 2021/0180535 | A1 * | 6/2021 | Graichen | F02D 41/3005 |
| 2022/0412279 | A1 * | 12/2022 | Niemeyer | F02D 41/30 |
| 2023/0093283 | A1 * | 3/2023 | Niemeyer | F02D 41/1402 701/103 |

FOREIGN PATENT DOCUMENTS

| | | | |
|---|---|---|---|
| DE | 10 2014 225 039 | A1 | 6/2016 |
| DE | 10 2015 204 218 | A1 | 9/2016 |
| DE | 10 2018 001 727 | A1 | 9/2019 |
| EP | 3 062 176 | A2 | 8/2016 |

* cited by examiner

| Input | monotone | linear |
|---|---|---|
| pES | ⇧ | ✓ |
| pLL | ⇧ | ✓ |
| mKrSt | ⇧ | ✓ |
| SB | ⇧ | ✓ |
| pCR | ⇧ | ✓ |
| nIST | X | ✓ |
| TLL | ⇧ | ✓ |

METHOD FOR THE MODEL-BASED OPEN-LOOP AND CLOSED-LOOP OF AN INTERNAL COMBUSTION ENGINE

CROSS REFERENCE TO RELATED APPLICATIONS

This is a continuation of PCT Application No. PCT/EP2021/051077, entitled "METHOD FOR THE MODEL-BASED OPEN-LOOP AND CLOSED-LOOP CONTROL OF AN INTERNAL COMBUSTION ENGINE", filed Jan. 19, 2021, which is incorporated herein by reference. PCT Application No. PCT/EP2021/051077 claims priority to German Patent Application No. 10 2020 000 327.3, filed Jan. 21, 2020, which is incorporated herein by reference.

BACKGROUND OF THE INVENTION

1. Field of the Invention

The invention relates to a method for model-based open-loop and closed-loop control of an internal combustion engine.

2. Description of the Related Art

The behavior of an internal combustion engine is largely determined by an engine control unit depending on a performance requirement. For this purpose, corresponding characteristic curves and diagrams are applied in the software of the engine control unit. Via these, the manipulated variables are calculated for the internal combustion engine from the power requirement, for example the start of injection and a required rail pressure. These characteristic curves/diagrams are populated with data by the manufacturer of the internal combustion engine during a test bench run. However, the large number of these characteristic curves/diagrams and the interaction of the characteristic curves/diagrams with one another require a great deal of coordination.

Attempts are therefore made in practice to reduce the coordination effort by using mathematical models. DE 10 2018 001 727 A1 for example, describes a model-based method wherein, depending on a setpoint torque, the injection system setpoints for controlling the injection system actuators are calculated via a combustion model; and wherein the gas path setpoints for controlling the gas path actuators are calculated via a gas path model. An optimizer then calculates a quality measure based on the injection system and the gas path setpoints and changes the setpoints with the aim of finding a minimum within a prediction horizon. When a minimum is found, the optimizer sets the injection system and gas path setpoints as critical for adjusting the operating point of the internal combustion engine. Additionally, it is known from this reference that the combustion model is adapted during operation of the internal combustion engine depending on a model value, whereby the model value is in turn calculated via a first Gaussian process model to represent a basic grid and via a second Gaussian process model to represent adaptation data points. In test bench trials, it has now been shown that adaptation in unfavorable operating situations can cause local minimums for the optimization. The result of the optimization then does not correspond with the global optimum for the operation of the internal combustion engine.

What is needed in the art is to further develop the previously described method in regard to improved quality.

SUMMARY OF THE INVENTION

The present invention provides a method for a model-based open-loop and closed-loop control of an internal combustion engine, in which the injection system setpoint values for controlling the injection system actuators are determined via a combustion model, according to a setpoint torque; during operation of the internal combustion engine, a combustion model is adapted according to a model value (E[X]), wherein model value (E[X]) is calculated from a first Gaussian process model for representing a base grid and a second Gaussian process model for representing adaptation data points; a minimized measure of quality is determined by an optimizer by changing the injection system setpoint values within a prediction horizon, and, in the event that a minimized measure of quality is found, the injection setpoint values are set as critical for adjusting the operating point of the internal combustion engine, the model value (E[X]) being monitored in respect of a predefined monotony.

The present invention provides a method, wherein the model value is monitored in regard to a specified monotony. The method according to the present invention is in addition to the method known from DE 10 2018 001 727 A1. The model value is calculated from the first Gaussian process model to represent the base grid and the second Gaussian process model to represent adaptation data points. Monotony is defined according to an increasing trend with a positive setpoint gradient for the model value or according to a decreasing trend with a negative setpoint gradient for the model value. The monotony is monitored by evaluating the gradient of the model value at the operating point. If a monotony deviation is detected, the monotony is corrected by smoothing data points of the second Gaussian process model to attain the monotony. In other words: The data points stored in the second Gaussian process model are moved by way of smoothing until the monotony corresponds again to the specification. When the first Gaussian process model is reconfigured via the second Gaussian process model, the monotony properties of the first Gaussian process model are left unchanged.

By monitoring the monotony, the influence of, for example, measurement errors, in other words, incorrect data values, is considerably reduced. This ensures that the combustion model behaves in a physically correct and well-behaved manner. Since the optimizer relies on the combustion model, sufficiently accurate injection system setpoints and a global optimum are guaranteed. In addition, the extrapolation capability of the combustion model remains unchanged.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
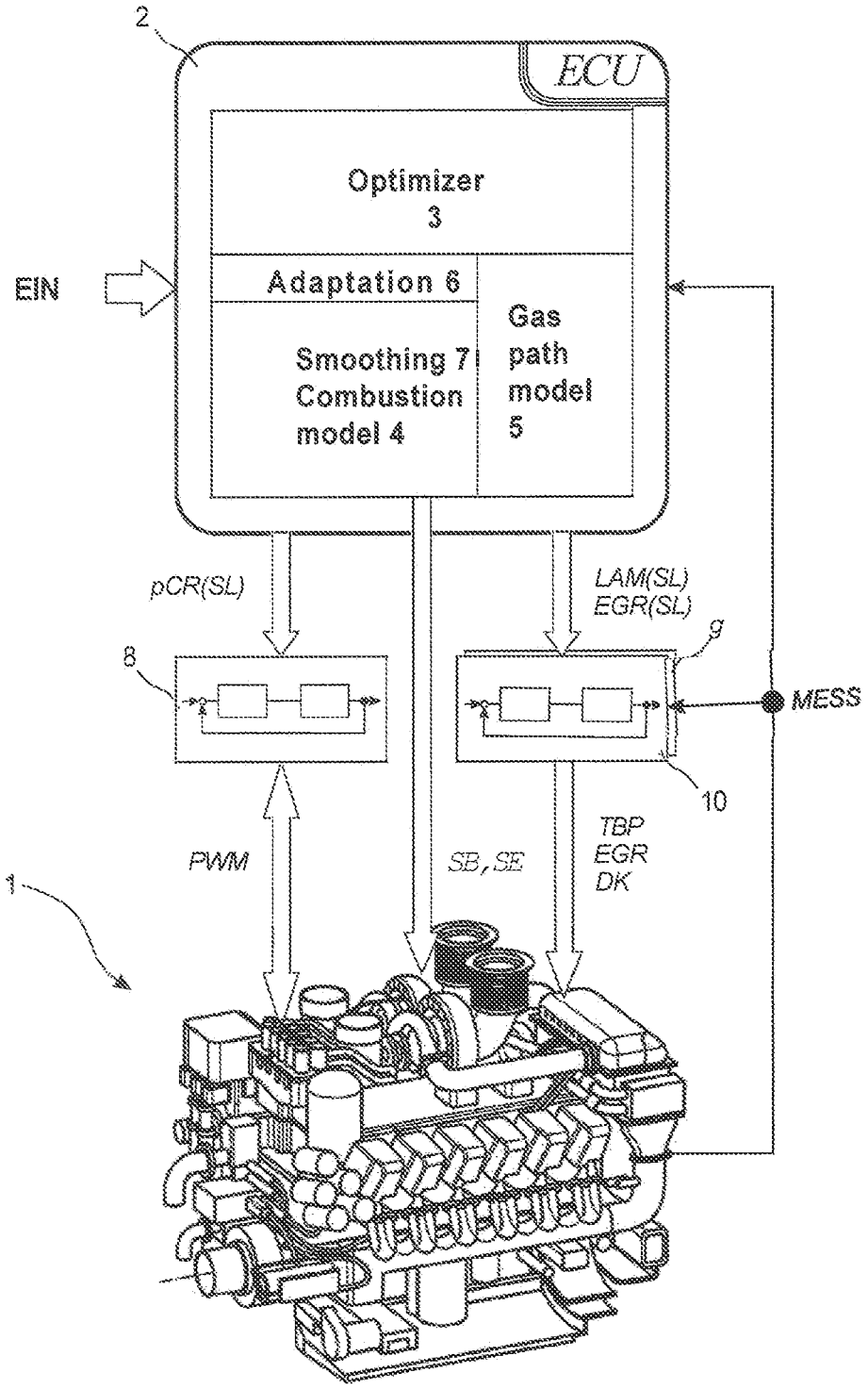
FIG. 1 is a system diagram.

FIG. 1 shows a system diagram of a model-based, electronically controlled internal combustion engine 1, for example a diesel engine with a common rail system. The structure of the internal combustion engine and the function of the common rail system are known, for example, from DE 10 2018 001 727 A1. The input values of electronic control unit 2 are shown with the reference identifications EIN and MESS. Identification EIN includes for example the operator's performance requirement, the libraries used to establish emission class MARPOL (Marine Pollution) of IMO, or the EU emission class IV/tier 4 final, and the maximum mechanical component load. Typically, the performance requirement is specified as a setpoint torque, a setpoint speed, or an accelerator pedal position. Typically, the power request is specified as a setpoint torque, a setpoint speed, or an accelerator pedal position. Input value MESS identifies both the directly measured physical values and the auxiliary values calculated from them. The output values of electronic control unit 2 are the setpoint values for the subordinate control loops and the start of injection SB and end of injection SE.

A combustion model 4, an adaptation 6, smoothing 7, a gas path model 5 and an optimizer 3 are arranged within electronic control unit 2. Combustion model 4 as well as gas path model 5 represent the system behavior of the internal combustion engine 1 in the form of mathematical equations. Combustion model 4 statically represents the processes during combustion. In contrast, gas path model 5 represents the dynamic behavior of the air flow and the exhaust gas flow. Combustion model 4 includes individual models, for example for NOx and soot formation, for exhaust gas temperature, for exhaust gas mass flow and for peak pressure. These individual models are again determined depending on the boundary conditions in the cylinder and the injection parameters. In a reference internal combustion engine, combustion model 4 is determined in a test bench run, the so-called DoE test bench run (DoE: Design of Experiments). In the DoE test bench run, operating parameters and manipulated variables are systematically varied with the objective of mapping the overall behavior of the internal combustion engine depending on engine variables and environmental boundary conditions. Combustion model 4 is supplemented by adaptation 6 and smoothing 7. The purpose of adaptation is to adapt the combustion model to the actual behavior of the engine system. Smoothing 7, in turn, is used to monitor and maintain monotony.

Following activation of internal combustion engine 1, optimizer 3 initially reads in, for example, the emission class, the maximum mechanical component loads and the setpoint torque as a performance request. Optimizer 3 then evaluates combustion model 4 with regard to the setpoint torque, the emission limit values, the environmental boundary conditions, for example the humidity phi of the charge air, the operational situation of the internal combustion engine and the adaptation data points. The operational situation is defined in particular by the engine speed, the charge air temperature, and the charge air pressure. The function of optimizer 3 is now to evaluate the injection system setpoints for controlling the injection system actuators and the gas path setpoints for controlling the gas path actuators. Optimizer 3 selects the solution that minimizes a quality measure. Quality measure J is calculated as being integral to the quadratic setpoint-actual deviations within the prediction horizon. For example, in the form:

$$J=\int[w1(\mathrm{NOx}(\mathrm{SOLL})-\mathrm{NOx}(IST))]^2+[w2(M(\mathrm{SOLL})-M(IST))]^2+[w3(\ldots)]+\ldots \quad (1)$$

w1, w2 and w3 herein represent corresponding weighting factors. As is known, the nitrogen oxide emission NOx results from the humidity in the charge air, the charge air temperature, injection start SB and the rail pressure. Adaptation 9 intervenes in the actual values, for example the NOx actual value or the exhaust gas temperature actual value. A detailed description of the quality measure and the termination criteria can be found in DE 10 2018 001 727 A1.

The quality measure is minimized in that a first quality measure is calculated by optimizer 3 at a first point in time; subsequently the injection system setpoint values and the gas path setpoint values are varied and based on these, a second quality measure is forecast within the prediction horizon. Based on the deviation of the two quality measures from one another, optimizer 3 then establishes a minimum quality measure which are set as critical for the internal combustion engine. For the example shown in the figure, these are the setpoint rail pressure pCR(SL), the start of injection SB and the end of injection SE for the injection system. The setpoint rail pressure pCR(SL) is the reference variable for subordinate rail pressure control loop 8. The manipulated variable of rail pressure control loop 8 corresponds to the PWM signal for activating the suction throttle. At the beginning of the injection process SB and the end of the injection process SE, the injector is directly impacted. Optimizer 3 indirectly determines the gas path setpoints for the gas path. In the example shown, these are a lambda setpoint LAM(SL) and an EGR setpoint EGR(SL) to specify for the subordinate lambda control loop 9 and the subordinate EGR control loop 10. When using a variable valve control, the gas path setpoints are adjusted accordingly. The manipulated variables of the two control loops 9 and 10 correspond to signal TBP for controlling the turbine bypass, signal EGR for controlling the EGR actuator and signal DK for controlling the throttle valve. The returned measured values MESS are read in by electronic control unit 2. Measured values MESS include both directly measured physical variables and auxiliary values calculated therefrom. In the example shown, the actual lambda value and the actual EGR value are read in.

Figure 2:
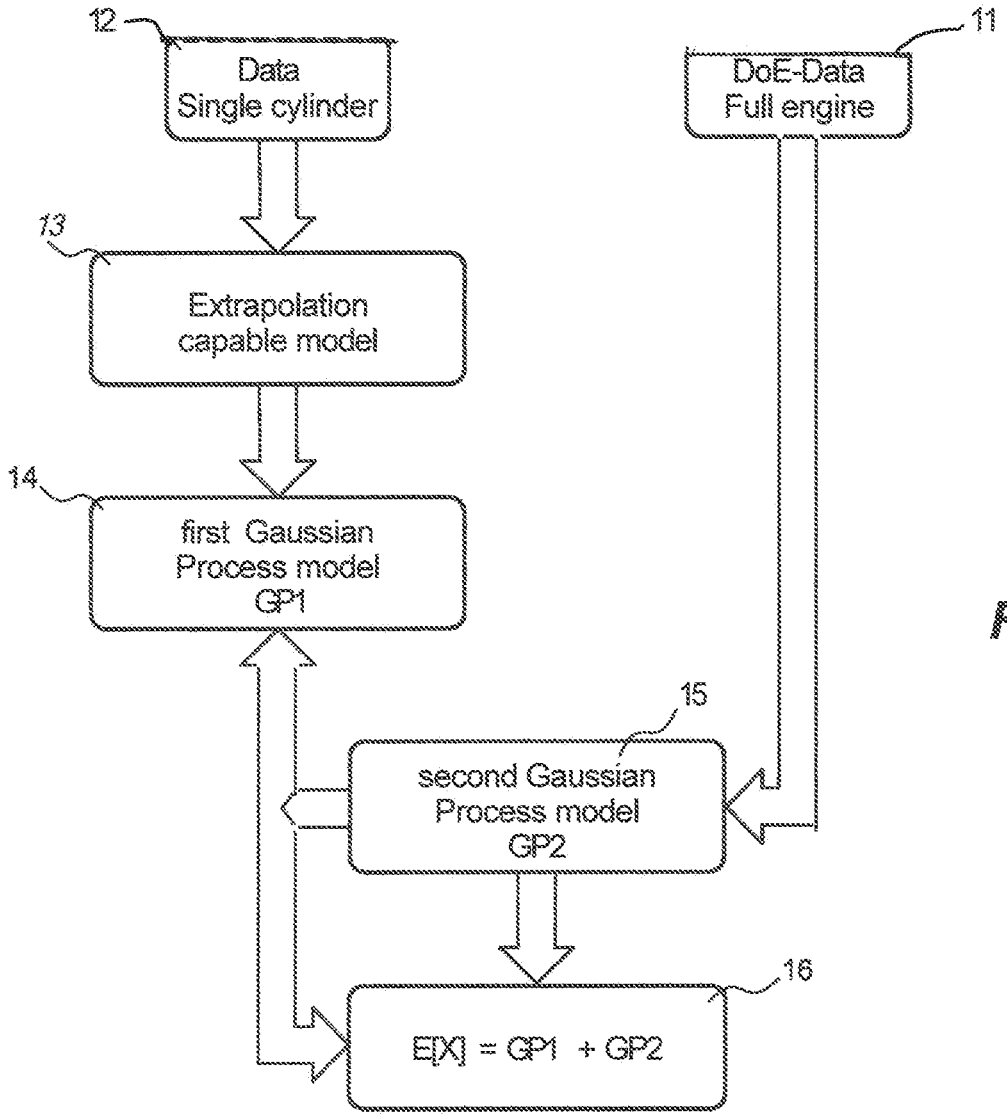
FIG. 2 is a block diagram.

FIG. 2 shows in a block diagram the interaction between the two Gaussian process models for the adaptation of the combustion model and for the determination of model value E[X]. Gaussian process models are known to the expert, for example from DE 10 2014 225 039 A1 or from DE 10 2013 220 432 A1. Generally speaking, a Gaussian process is defined by a mean value function and a covariance function. The mean function is often assumed to be zero, or a linear/polynomial progression is introduced. The covariance function gives the correlation of arbitrary points. A first function block 11 includes the DoE data (DoE: Design of Experiments) of the full engine. This data is determined for a reference internal combustion engine during a test bench run by determining all variations of the input values over the entire control range of the engine in the stationary driving range. This data characterizes with high accuracy the behavior of the internal combustion engine in the stationary driving range. A second function block 12 includes data obtained on a single-cylinder test bench. Operating ranges can be set on the single-cylinder test bench, for example high geodetic altitude or extreme temperatures, which cannot be tested on a DoE test bench run. This measurement data serves as the basis for parameterizing a physical model that vaguely correctly reflects the global behavior of the combustion. The physical model roughly represents the behavior of the internal combustion engine in extreme boundary conditions. The physical model is completed via extrapolation so that a normal operating range is described roughly correctly. In FIG. 2, the extrapolation-capable model is identified with reference number 13. From this, first Gaussian process model 14 (GP1) is generated in turn, to represent a basic grid.

The merger of the two groups of data points forms second Gaussian process model (GP2) 15. Operating ranges of the internal combustion engine which are described by the DoE data are thereby also defined by these values and operating ranges for which no DoE data is available are reproduced by data of the physical model. Since second Gaussian process model 15 is adapted during operation, it is used to represent the adaptation points. Generally, therefore, the following applies for model value E[X]; see reference number 16:

$$E[X]+GP1+GP2 \tag{2}$$

GP1 corresponds herein to the first Gaussian process model for representing basic grid, GP2 corresponds to the second Gaussian process model for representing the adaptation data points, and model value E[X] corresponds to the input variable for both the smoothing and the optimizer, for example, an actual NOx value or an actual exhaust gas temperature value. Two information paths are illustrated by the double arrow in the drawing. The first information path identifies the data provision of the base grid from first Gaussian process model 14 to model value 16. The second information path characterizes the back-adaptation of Gaussian process model 14 via second Gaussian process model 1.

Figures 3, 4:
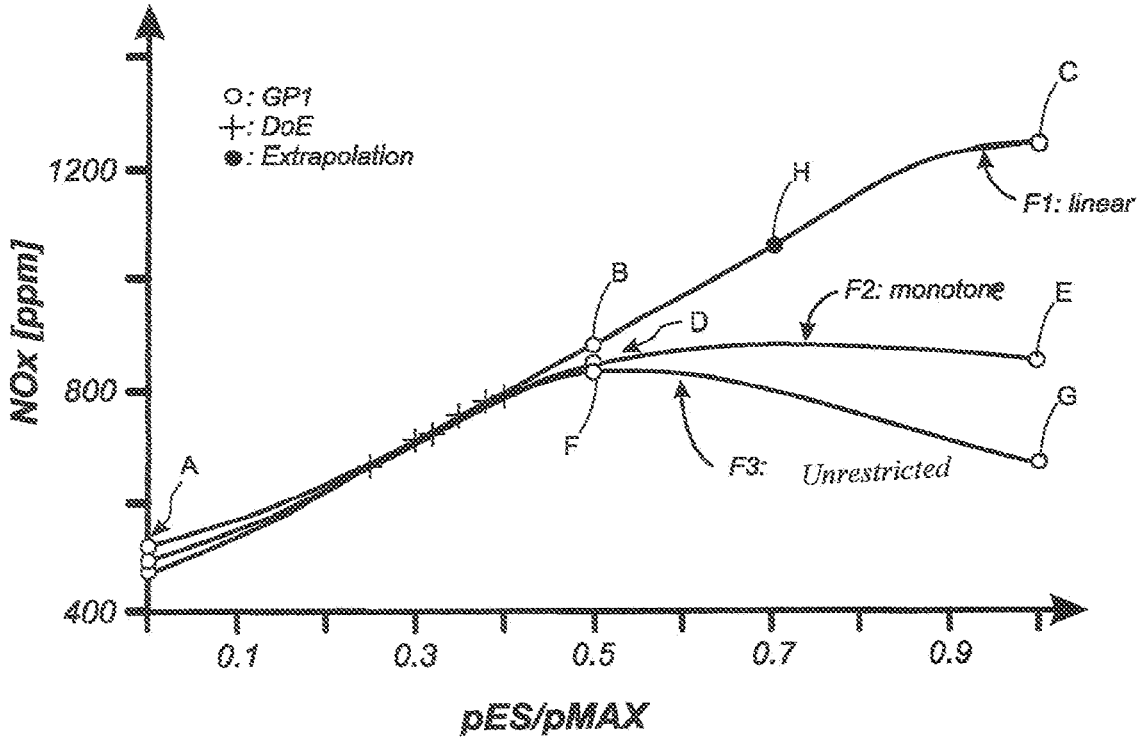
FIG. 3 is a diagram.
FIG. 4 is a table.

In a diagram in FIG. 3 the first Gaussian process model for the individual accumulator pressure pES is shown, which is standardized to the maximum pressure pMAX. The measured NOx value is plotted on the ordinate. In the diagram, the DoE data values determined on the full engine are marked with a cross. The data points from the first Gaussian process model are shown as circles. These data points are generated in that the trend determined from the data of the single cylinder test bench and in that the DoE data is efficiently represented. These are for example the three data values of points A, B, and C. In a first step, the position of the data values—in other words the trend information—to each other is determined. Since a higher actual NOx value results from the data value of point B than at point A, the function in this range is monotone. This applies in an analogous way for the data value at point C, in other words, the actual NOx value at point C is higher than at point B. For data values A to C, the trend information is therefore: monotonously and linearly increasing. In a second step, the deviation (model error) of these data values from the DoE data is minimized. In other words, a mathematical function is determined which best represents the DoE data values by considering the trend information. For data values A, B and C this is the monotone, linear and increasing function F1. A function F2 is characterized by data values A, D and E as monotone only. A function F3 is represented by data values A, F and G. With regard to FIG. 4, exemplary measured values of pES, fuel mass mKrSt, start of injection SB, rail pressure pCR and charge air temperature TLL act according to function F1, in other words, increasing in a monotone and linear manner. The measured motor speed value nIST acts according to function F3, in other words, unrestricted. Unrestricted means that no trend information is available for this measured value. Charge air pressure pLL decreases in a monotone manner. As can also be deduced from FIG. 3, intermediate values, for example data value H, can be extrapolated. Thus, the model is capable of extrapolation (FIG. 2: 13). Determination of the first Gaussian process model is automated, meaning that expert knowledge is not required. The automated extrapolation capability of the model guarantees a high level of durability, since—based on the trend information—the model does not permit extremes or erratic reactions in unknown areas.

Figure 5:
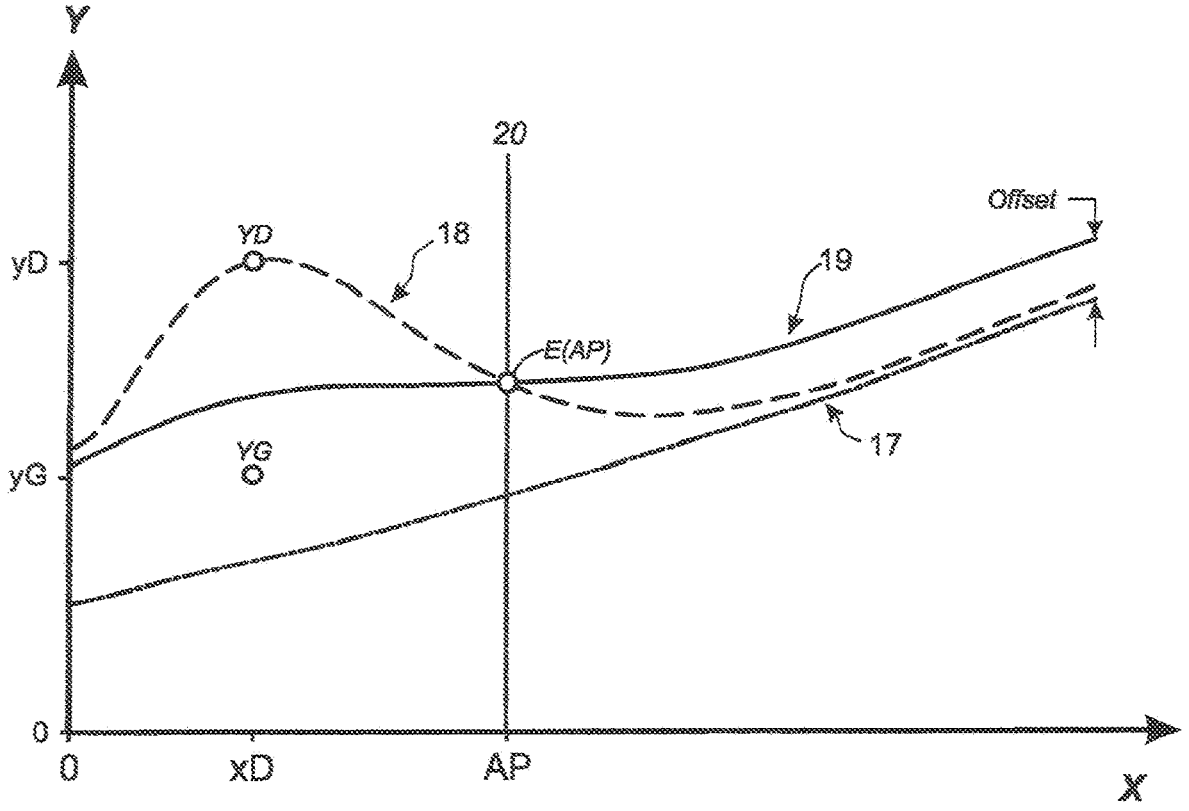
FIG. 5 is a diagram of model behavior.

FIG. 5 shows a diagram regarding the behavior of the combustion model. In the drawing, a first quantity X is shown on the abscissa, for example the individual accumulator pressure (FIG. 4: pES). A second quantity Y is shown on the ordinate, for example the NOx value. Dashed-dotted line 17 illustrates the progression of first Gaussian process model GP1, in other words of the base grid, depending on a first value X and second value Y. Dashed line 18 identifies the progression of model value E[X] in the initial state, that is, without smoothing. Model value E[X] is calculated from the sum of first and second Gaussian process model. Solid line 19 identifies a smoothed progression of model value E[X]. An operating point, abscissa value AP, of size X is drawn as an ordinate parallel line 20.

The further explanation in regard to FIG. 5 is based on a monotony with a positive increasing trend and a positive setpoint gradient in the first Gaussian process model. In addition, it is specified for the model behavior that the monotony characteristic of the first Gaussian process model must not be changed by the second Gaussian process model and that the monotony characteristics are guaranteed at the current operating point. After detection of current operating point AP, model value E[X] which corresponds to the operating point—in this case E(AP) is calculated. Then, the model progression E[X] in operating point E[AP] is evaluated. Model value progression 18 shows a decreasing trend with a negative actual gradient in operating point AP. This behavior is caused by a local maximum of the model, which in turn causes a local minimum in the calculation of the quality measure. As a consequence, the optimizer then calculates unsuitable manipulated variables for the subordinate control loops on the basis of the model value. In other words, model value E[X] which is calculated from the first and second Gaussian process model, contradicts the required monotony characteristic, so that the optimizer does not set the optimum operating point for the internal combustion engine.

According to the invention, the method now provides, that the monotony of the model value is monitored and, if a violation of the monotony is detected, the combustion model is smoothed. Specifically, this occurs by changing of the adaptation data values of the second Gaussian process model. As shown in the drawing, a stored data point YD with coordinates (xD/yD) is thus changed in the direction of the basic grid (line 17). The abscissa value remains constant in this example. The change relative to the original data point YD is to be relatively small. This can be described as minimization of the quadratic deviation of the smoothed datapoints, as follows:

$$\min YG\Sigma(YD(i)-YG(i))^2 \text{ by considering the monotony characteristic} \tag{3}$$

Herein, YD identifies the stored data point, i identifies a control variable, and YG identifies the smoothed data point at location xD. Thus, via correlation (3), stored data point YD and thereby model value curve 18 is changed in the direction of progression 17 of the first Gaussian process model to achieve the specified monotony characteristic.

Figure 6:
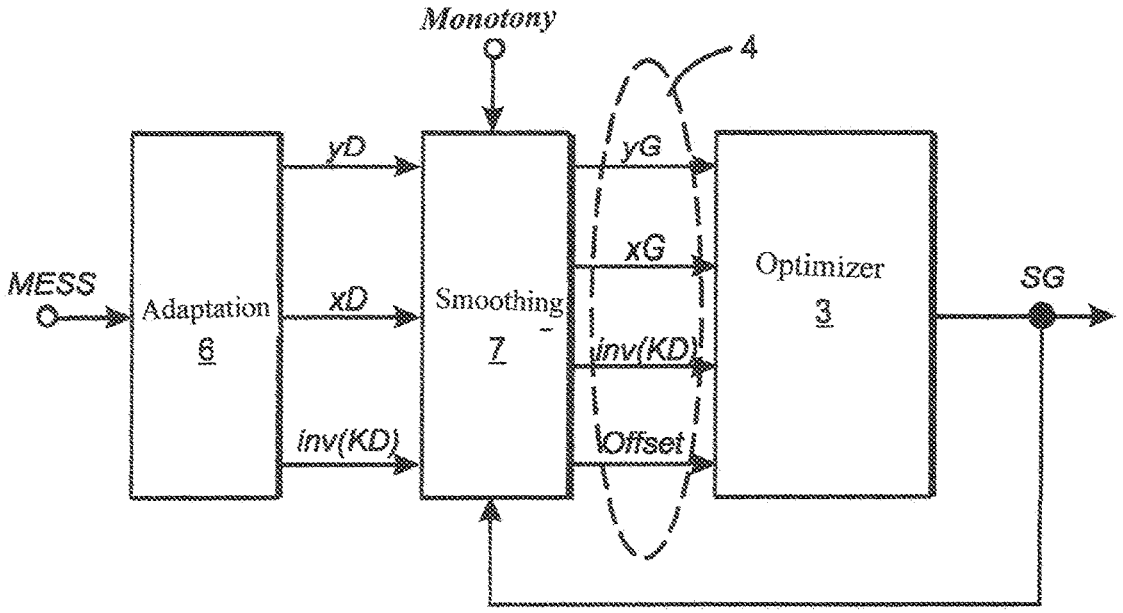
FIG. 6 is a block diagram.

FIG. 6 shows the process again in block diagram. The input value herein is value MESS, which identifies the actual operating point. The output value corresponds to the model value E[X] is calculated from value MESS and the data points which are already stored. This is determined by the first Gaussian process model to represent the basic grid and by the second Gaussian process model to calculate adaptation data values. In accordance with FIG. 5, in this representation, a set of data values yD, a set of abscissa values xD, and an inverse covariance matrix inv(KD) are passed from adaptation 6 to smoothing 7. Via smoothing 7, the specified monotony is monitored on the basis of the setpoint gradient at the operating point; and the combustion model is smoothed if a violation of the monotony is detected. Smoothed values yG, smoothed values xG, associated inverse covariance matrix inv(KG), and the corresponding offset are then passed from smoothing 7 on to combustion model 4 and thus to optimizer 3.

Figure 7:
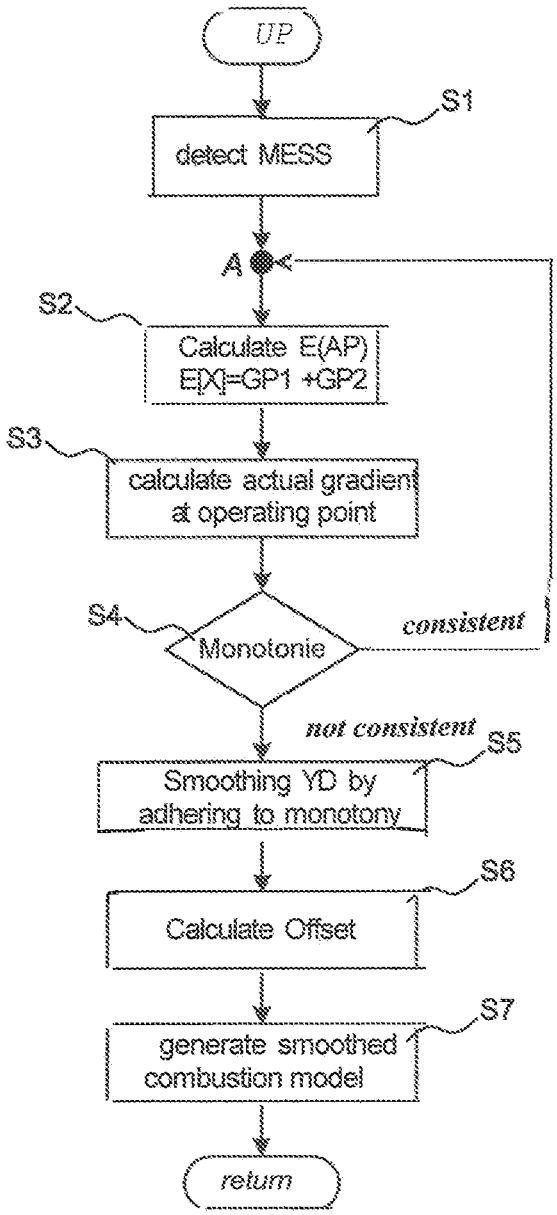
FIG. 7 is a program flow chart.

FIG. 7 illustrates the invention in a program flow chart. The program flow chart is an addition to the program flow chart that is known from DE 10 2018 001 727 A1. At S1 the measured values MESS are read in and at S2 a model value E[X] is calculated via the first and second Gaussian process model, in this case: model value E(AP) at the operating point. Then, the actual gradient at the operating point is determined at S3. At S4 the monotony is again verified by way of a comparison of the setpoint gradient with the actual gradient. In case of sign consistency, branching occurs back to point A. If a violation of monotony was detected at S4, stored data point YD is changed to smoothed data point YG at S5 via correlation (3) with the objective of sign consistency of the gradient and by adhering to the monotony. The offset is then calculated at S6, and a smoothed combustion model is subsequently generated herewith at S7. The smoothed combustion model in turn is an input value of the optimizer, in other words, it is returned to the main program.

IDENTIFICATION LISTING

1. Internal combustion engine
2. Electronic control unit
3. Optimizer
4. Combustion model
5. Gas path model
6. Adaptation
7. Smoothing
8. Rail pressure control loop
9. Lambda control loop
10. EGR control loop
11. First function block (DoE-data)
12. Second function block (data—single cylinder)
13. Model, extrapolation capable
14. First Gaussian process model (GP1)
15. Second Gaussian process model GP2)
16. Model value
17. Progression GP1
18. Progression model value, initial state
19. Progression model value, smoothed
20. Line While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method for a model-based open-loop and closed-loop control of an internal combustion engine, the method comprising the steps of:

determining, via a combustion model, a plurality of injection system setpoint values for controlling a plurality of injection system actuators, according to a setpoint torque;

adapting, during an operation of the internal combustion engine, the combustion model according to a model value, the model value being calculated from a first Gaussian process model for representing a base grid and a second Gaussian process model for representing a plurality of adaptation data points;

determining, by an optimizer, a minimized measure of quality by changing the plurality of injection system setpoint values within a prediction horizon, and, in an event that the minimized measure of quality is found, the plurality of injection system setpoint values are set for adjusting an operating point of the internal combustion engine; and monitoring the model value in respect of a monotony which is predefined, wherein if a monotony deviation is detected, the monotony is corrected by smoothing a plurality of data points of the second Gaussian process model to attain the monotony which is specified.

2. The method according to claim 1, wherein the monotony is an increasing trend with a positive setpoint gradient for the model value.

3. The method according to claim 1, wherein the monotony is a decreasing trend with a negative setpoint gradient for the model value.

4. The method according to claim 3, wherein in order to monitor the monotony, the negative setpoint gradient of the model value is evaluated at the operating point.

5. The method according to claim 4, wherein in addition to the monotony, a linear dependency of a plurality of input values of the combustion model on the model value is monitored.

6. The method according to claim 1, wherein in an event of a back-adaptation of the first Gaussian process model via the second Gaussian process model, a plurality of monotony characteristics of the first Gaussian process model remain unchanged.

* * * * *